US007841952B1

(12) United States Patent
Oldknow et al.

(10) Patent No.: US 7,841,952 B1
(45) Date of Patent: Nov. 30, 2010

(54) GOLF CLUB WITH GOLF CLUB HEAD HAVING COMPRESSIBLE V-SHAPED GROOVES

(75) Inventors: Andrew G.V. Oldknow, Portland, OR (US); Donald S. Rahrig, Mansfield, TX (US)

(73) Assignee: Nike, Inc., Beaverton, OR (US)

( * ) Notice: Subject to any disclaimer, the term of this patent is extended or adjusted under 35 U.S.C. 154(b) by 1 day.

(21) Appl. No.: 12/469,831

(22) Filed: May 21, 2009

(51) Int. Cl.
*A63B 53/04* (2006.01)

(52) U.S. Cl. ..... 473/329; 473/331; 473/332; 473/349; 473/350

(58) Field of Classification Search ..... 473/324–350, 473/287–292
See application file for complete search history.

(56) References Cited

U.S. PATENT DOCUMENTS

| | | | | |
|---|---|---|---|---|
| 4,679,792 | A * | 7/1987 | Straza et al. | 473/329 |
| 4,768,787 | A | 9/1988 | Shira | |
| 5,100,144 | A | 3/1992 | Okumoto et al. | |
| 5,358,249 | A | 10/1994 | Mendralla | |
| 5,437,088 | A * | 8/1995 | Igarashi | 29/527.6 |
| 5,595,547 | A * | 1/1997 | Lekavich | 473/287 |
| 5,620,382 | A | 4/1997 | Cho et al. | |
| 5,688,186 | A | 11/1997 | Michaels et al. | |
| 5,709,616 | A | 1/1998 | Rife | |
| 6,217,460 | B1 | 4/2001 | Broadbridge et al. | |
| 6,849,004 | B2 | 2/2005 | Lindsay | |
| 7,014,568 | B2 * | 3/2006 | Pelz | 473/287 |
| 7,179,175 | B2 | 2/2007 | Kennedy, Ill | |
| 7,261,644 | B2 | 8/2007 | Burrows | |
| 7,465,240 | B2 * | 12/2008 | Frame | 473/329 |
| 7,717,801 | B2 * | 5/2010 | Franklin et al. | 473/251 |
| 2005/0009623 | A1 * | 1/2005 | Dickinson | 473/329 |
| 2005/0209020 | A1 * | 9/2005 | Burrows | 473/330 |
| 2009/0286620 | A1 | 11/2009 | Franklin et al. | |
| 2009/0286621 | A1 | 11/2009 | Franklin et al. | |
| 2010/0087269 | A1 * | 4/2010 | Snyder et al. | 473/329 |
| 2010/0167835 | A1 * | 7/2010 | Franklin et al. | 473/329 |

FOREIGN PATENT DOCUMENTS

| | | |
|---|---|---|
| GB | 2366211 | 3/2002 |
| JP | 9084909 | 3/1997 |

OTHER PUBLICATIONS

Pending U.S. Appl. No. 12/612,236 filed Nov. 4, 2009, "Putter Heads and Putters Including Polymeric Material As Part of The Ball Striking Face".

* cited by examiner

*Primary Examiner*—Sebastiano Passaniti
(74) *Attorney, Agent, or Firm*—Banner & Witcoff, Ltd.

(57) ABSTRACT

A golf club with a golf club head having compressible v-shaped grooves is presented. The club head may include a plurality of grooves formed in a striking face. In some arrangements, the grooves have a rectangular cross section. The grooves may also include a compressible insert having a v-shaped end and being formed of a material softer than that of the grooves. As the club head strikes a golf ball, the insert may compress, thereby allowing additional contact between the groove and the ball to impart spin on the ball. In an alternate arrangement, the groove may include a compressible support arranged between the insert and an end of the groove. The compressible insert may be formed of a material softer than the groove and/or the insert and is configured to compress when the club head strikes a golf ball.

16 Claims, 4 Drawing Sheets

GOLF CLUB WITH GOLF CLUB HEAD HAVING COMPRESSIBLE V-SHAPED GROOVES

FIELD OF THE INVENTION

This invention relates generally to golf clubs. In particular, the invention relates to golf clubs having grooves formed in the face of the club having a v-shaped insert contained therein that is configured to compress when a ball is struck with the face of the club.

BACKGROUND

The popularity of the game of golf has increased immensely in recent decades. All manner of players are looking for equipment that will improve an individual's performance, thereby making the game more enjoyable. As golf regulating bodies, such as the U.S.G.A., institute rules and limitations on the design, configuration, etc. of golf clubs, clubs must be designed to remain within the regulations of the ruling body, while providing expected or improved performance.

One such regulation deals with club head grooves and their shape, size, configuration, etc. In order to meet club design regulations and provide improved performance characteristics, a v-shaped groove design that provides performance similar to a u-shaped groove would be advantageous to golfers.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to golf clubs having groove in the striking face. In some arrangements, the grooves may have a generally rectangular cross section and may include a compressible v-shaped insert. The insert may be surrounded by the groove on three sides and the v-shaped side of the insert may be exposed, forming a portion of the striking face of the golf club head. As the club head strikes a golf ball, the v-shaped insert, formed of a softer or less dense material than the grooves, may compress, thereby increasing contact between the groove and the ball.

In some arrangements, the groove may include a compressible support in addition to the v-shaped insert. The compressible support may be arranged between the insert and a side of the groove. In some arrangements, the insert and the groove may be formed of the same material and the compressible support may be formed of a softer, less dense material to allow increased compressibility. The v-shaped side of the insert may be exposed and may form a portion of the striking face of the club. As the golf club head strikes a ball, the compressible support will compress, thereby increasing contact between the grooves and the ball.

BRIEF DESCRIPTION OF THE DRAWINGS

A more complete understanding of the present invention and certain advantages thereof may be acquired by referring to the following detailed description in consideration with the accompanying drawings, in which.

Figure 1:
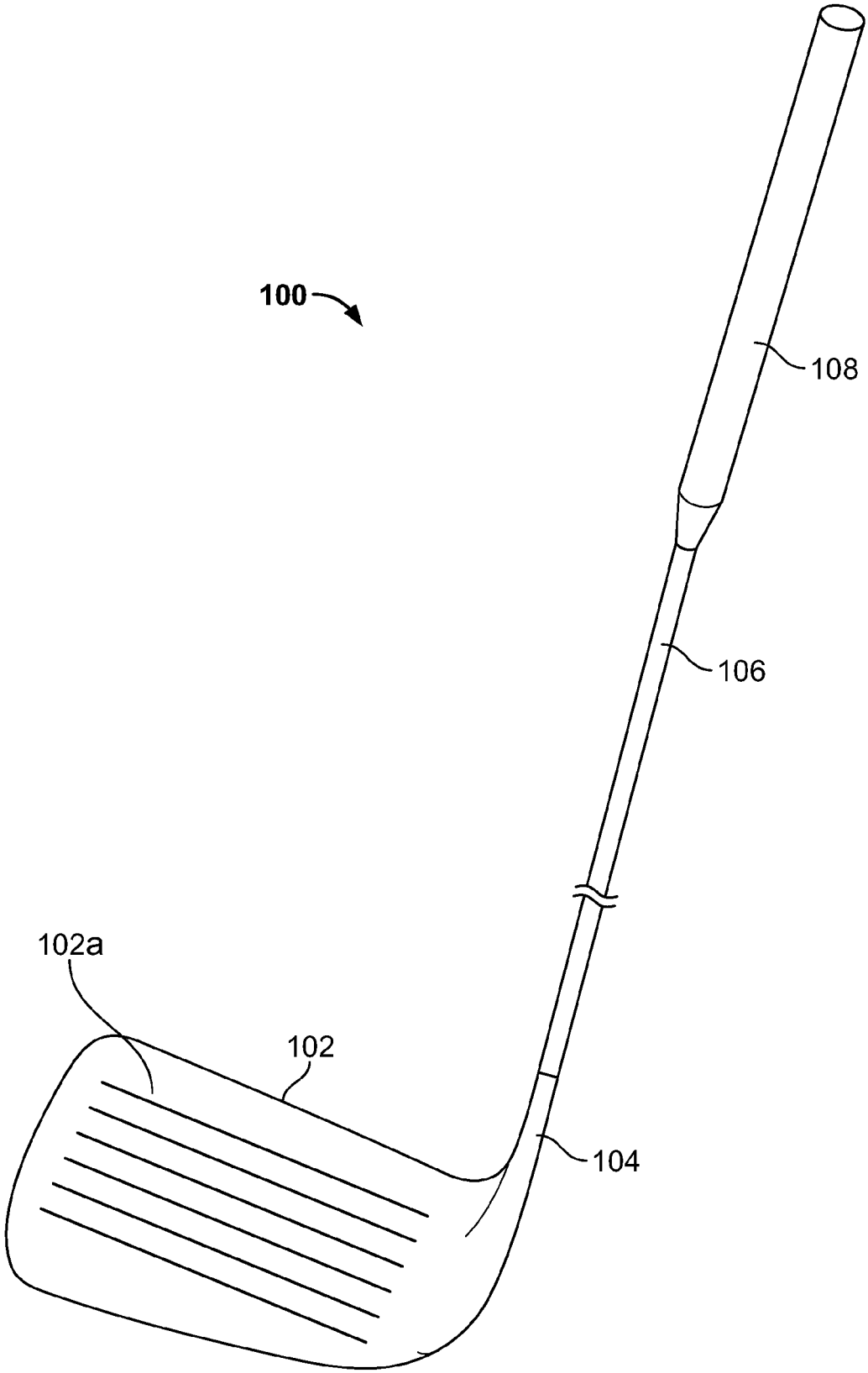
FIG. 1 is an example golf club having v-shaped club head grooves in accordance with illustrative aspects of the invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to iron-type golf clubs. However, aspects of the invention may be used with any of several types of golf clubs, including wood-type golf clubs, hybrid type golf clubs, and the like and nothing in the specification or figures should be construed to limit the invention to use with the iron-type golf clubs described.

A. General Description of an Illustrative Golf Club with Golf Club Head Having Compressible V-Shaped Grooves In general, as described above, aspects of this invention relate to a golf club or golf club head structure. More detailed descriptions of aspects of this invention follow.

1. Example Golf Clubs Having Compressible V-Shaped Grooves

Aspects of this invention relate to golf club and golf club head structures. In at least some examples, the golf club head includes a plurality of grooves formed therein. In some arrangements, the grooves may have a rectangular cross section and may have an open end that corresponds to the striking face of the golf club head. In some examples, the grooves may include an insert shaped to correspond to the shape of the groove. The insert may include a v-shaped end corresponding to the open end of the groove and forming a portion of the striking face of the club.

In some examples, the groove may be formed of the same material as the face of the golf club head. This material may be a dense material, such as metal, composite, and the like. The insert may be formed of a softer material, i.e., a material having a softer durometer than the metal of the face and grooves, and may be configured to compress when the club head strikes a golf ball. In some examples, the insert will compress to a greater degree than the grooves. Compression of the insert increases contact between the grooves and the ball, thereby providing spin similar to that of a u-shaped groove. In some examples, the grooves may surround the inserts on three sides and may be in contact with the inserts on three sides.

In still other examples, the grooves may include a compression support arranged between the insert and the groove. The compression support may be formed of a less dense, softer material, i.e., a material having a softer durometer than that of the groove, and is configured to compress when the golf club strikes a golf ball. In some arrangements, the insert may be formed of the same or similar material to the groove. Alternatively, the insert may also be formed of a softer material than that of the groove.

Additional aspects and specific examples of the articles described above will be described in detail more fully below. The reader should understand that these specific examples are set forth merely to illustrate examples of the invention, and they should not be construed as limiting the invention.

B. Specific Examples of the Invention

Referring to the figures and following discussion, golf clubs and golf club heads in accordance with the present invention are described. As discussed above, the golf club and club head structures described herein may be described in terms of iron-type golf clubs. However, the present invention is not limited to the precise arrangements disclosed herein but applies to golf clubs generally, including wood-type clubs, hybrid clubs, and the like.

Example golf club and golf club head structures in accordance with this invention may constitute iron-type golf clubs. However, aspects of this invention may related to "wood-type" golf clubs and golf club heads, e.g., clubs and club heads typically used for drivers and fairway woods, as well as for "wood-type" utility or hybrid clubs, or the like. Although these club head structures may have little or no actual "wood" material, the still may be referred to conventionally in the art as "woods" (e.g., "metal woods," "fairway woods," etc.). The club heads described herein may include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of golf club heads and golf club structures according to this invention will be described in detail below in conjunction with the example golf club structures illustrated in FIGS. 1 through 5.

FIGS. 1A and 1B generally illustrate an example golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example structure 102 shown in FIG. 1, the club head 102 includes a ball striking face member 102*a* (optionally including a ball striking face plate integrally formed with the face member 102*a* or attached to club such that the face plate and a frame member together constitute the overall face member 102*a*). The club head 102 of may further include a crown, a sole, and at least one body portion located between the crown or top portion and the sole (e.g., material extending from the face member, around the club head periphery from the heel to the toe). This body portion, which extends to a location substantially opposite the striking face, may include a rear portion of the club head structure.

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown, sole, and/or body portion(s)) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. Additionally or alternatively, the various parts of the club head may be formed of one or more composite materials.

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate, the crown, the sole, and/or the body portion(s) may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

Figure 2:
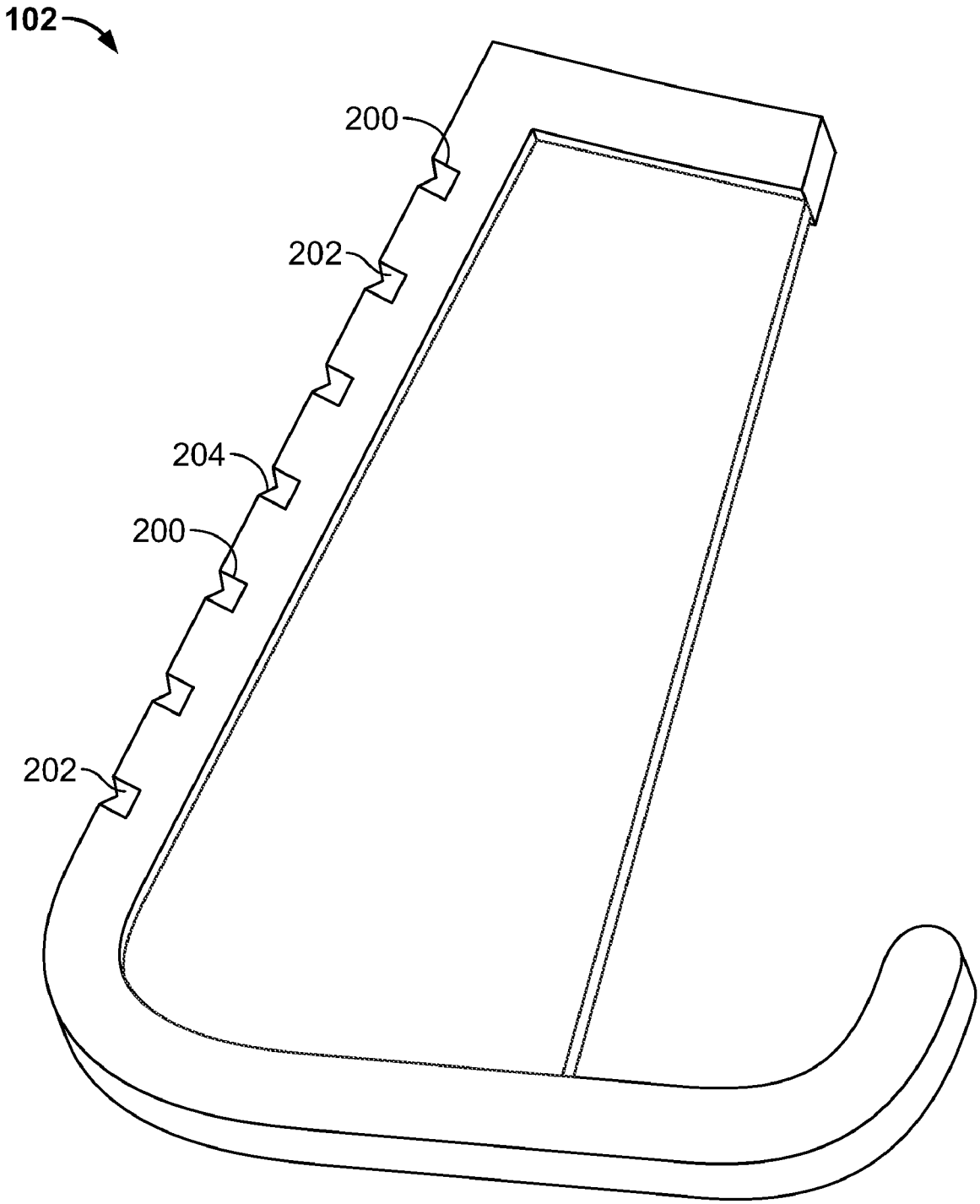
FIG. 2 is a cross sectional view of the example golf club head shown in FIG. 1 and having v-shaped club head grooves in accordance with illustrative aspects of the invention.

With reference to FIG. 2, the golf club head 102 of FIG. 1 further includes a plurality of grooves 200 formed therein. The grooves 200 may be formed during the initial fabrication of the club head 102 (i.e., molded into the face 102*a*) or may be cut in after the manufacture of the face. In some arrangements, the grooves 200 may have a depth of 0.010 to 0.020 inches and a width of 0.020 to 0.035 inches. In addition, the plurality of grooves 200 may have a generally square or rectangular cross section. That is, when the grooves 200 are formed in the club head 102, the grooves 200 may have a generally square or rectangular cross section, however, one end may be exposed or open. In addition, the grooves 200 may include an insert 202 or filler portion that may be contained within each of the grooves 200. The insert 202 may have a generally square or rectangular cross section to correspond to the associated groove 200. The insert 202 may also have a generally v-shaped side 204 that is exposed. Generally speaking, the groove 200 formed in the face of the club 100 may surround the insert 202 on three sides and the insert 202 may have a v-shaped side 204 that forms a portion of the striking face of the club head 102.

In some arrangements, the grooves 200 may be integrally formed with the club head 102 or face 102*a*. That is, the grooves 200 and face 102*a* may be formed of the same material. In some arrangements, that material may be a metal, such as carbon steel, stainless steel, titanium (AO), etc., any type of hard coating (such as chrome or NANO), composite, and the like. Materials may be selected to make the grooves 200 sharp and durable. The material forming the grooves 200 may be a dense material to provide a sound striking surface for the club head 102.

Further, the golf club groove insert 202 may be formed of a material that is less dense than the material forming the surrounding grooves 200. For instance, the insert 202 may be formed of a soft durometer material, such as a polymer or thermal plastic, a metal softer than the metal used to form the surrounding grooves 200, etc., that may be configured to compress when the club head 102 strikes a ball, as will be discussed more fully below.

Figure 3A:
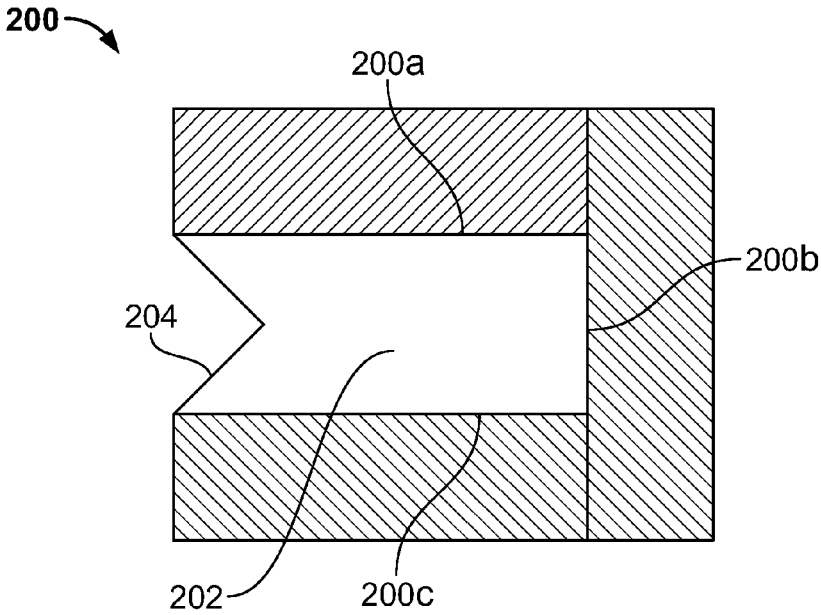
FIG. 3A is an enlarged view of one example v-shaped club head groove in a non-compressed position in accordance with illustrative aspects of the invention.
Figure 3B:
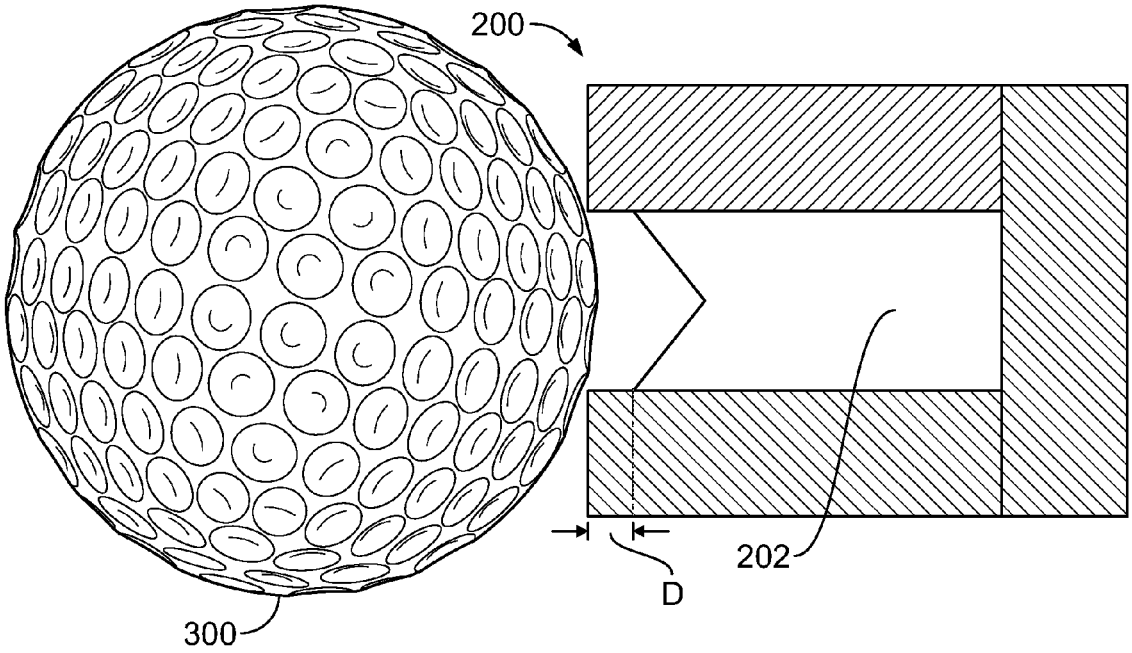
FIG. 3B is an enlarged view of the example v-shaped club head groove of FIG. 3A as shown in contact with a golf ball and in a compressed position in accordance with illustrative aspects of the invention.

For example, FIGS. 3A and 3B illustrate one example groove 200 with v-shaped insert 202. The figures depict one enlarged groove 200 to illustrate compression of the insert 202. FIG. 3A illustrates a cross section of one groove 200 according to aspects described herein. The groove 200 has a generally rectangular cross section with three sides 200*a*-200*c* and one exposed end. The groove 200 may formed of a dense material, as described above. The insert 202 is generally surrounded by the groove 200 on three sides and, in some arrangements, may be in contact with the groove 200 on three sides. The insert 202 may be formed of a less dense or softer material than the groove material, as described above to permit compression of the insert 202 when the club head strikes a golf ball. The insert 202 may also include a v-shaped end 204 corresponding to the exposed end of the groove 200. The v-shaped end 204 of the insert 202 may form a portion of the striking face of the club head.

FIG. 3B illustrates one golf ball striking arrangement of the groove 200 and insert 202 shown in FIG. 3A. FIG. 3B also includes a golf ball 300, however, the scale of the ball 300 has been altered to more clearly illustrate compression of the insert 202. As the club face and plurality of grooves 200 strike the ball 300, the dense material forming the groove 200 may compress slightly. However, the insert 202, formed of a softer durometer material than the groove 200 itself, will compress a distance, D, as shown in FIG. 3B. Due to the softer nature of the insert material than the groove material, the insert 202 will compress to a greater extent than the groove 200. This compression of the insert 202 may cause the generally v-shaped insert 202 shown to exhibit behavior, performance characteristics, etc. of a u-shaped groove. For instance, as the insert 202 compresses, the adjacent denser metal of the groove 200 contacts the golf ball 300, thereby adding spin similar to a u-shaped groove. The spin imparted may be affected by the lie condition, loft of the club, and/or angle of attack.

Figure 4:
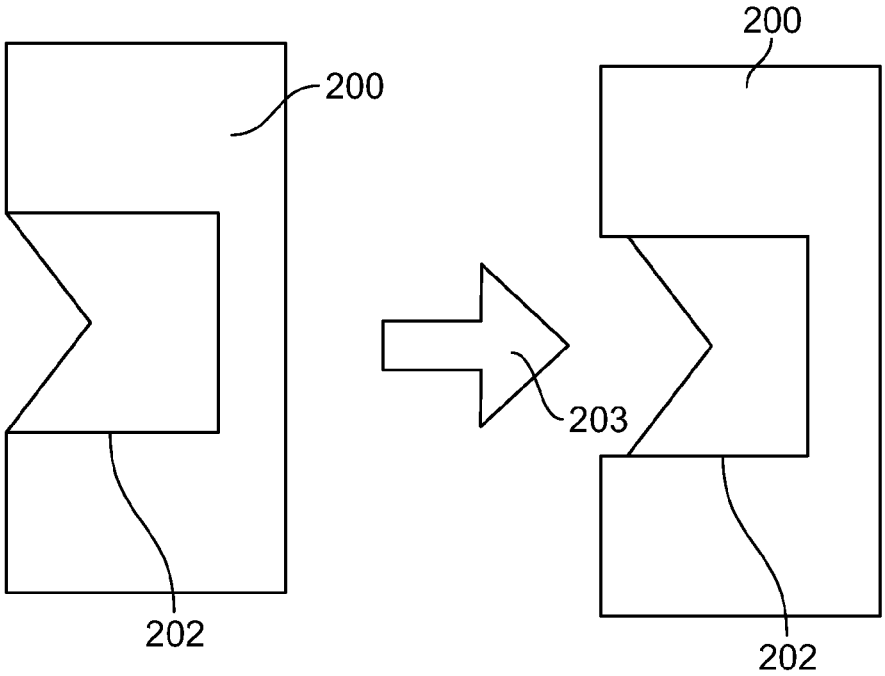
FIG. 4 is an enlarged, alternate view of one example v-shaped club head groove in a non-compressed and compressed position in accordance with illustrative aspects of the invention.

FIG. 4 illustrates this compression in an isolated view without the golf ball 300. The figure on the left illustrates one example groove 200 in a non-compressed, at-rest position. That is, the groove 200 may be formed in a club or club face that is not in contact with a golf ball. The figure on the right illustrates compression of the insert 202 when the club head, and therefore the groove 200 and insert 202, contact a golf ball. Arrow 203 indicates the force on the club face, groove 200 and insert 202 as the club head strikes a ball. As shown, the insert 202 may compress more than the groove 200, allowing contact between the metal of the groove 200 and the ball which will add spin similar to a u-shaped groove, as described above.

Figure 5:
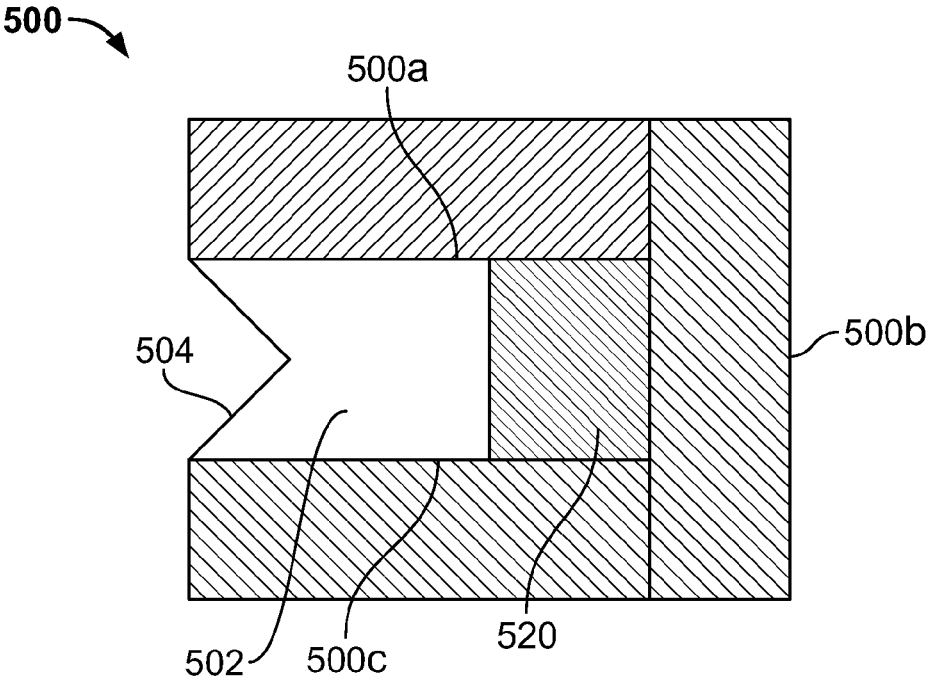
FIG. 5 is an enlarged view of an alternate arrangement of a v-shaped club head groove in accordance with illustrative aspects of the invention.

FIG. 5 illustrates an alternate arrangement of the groove and v-shaped insert arrangement described above. The groove 500 of FIG. 5 may be formed in any suitable golf club or club face, similar to the arrangement described above, and is generally shown in an enlarged view to illustrate details of the groove 500 and insert 502. Similar to the arrangement shown in FIG. 4, the groove 500 of FIG. 5 has a generally square or rectangular cross section. The groove 500 may include an insert 502 having a v-shaped end 504 that is contained within the groove 500. In addition, the groove 500 may include a compressible support 520 arranged between the insert 502 and the groove 500 (i.e., compressible support 520 may be positioned between the right most wall 500*b* of the groove 500 in FIG. 5 and the insert 502).

In the arrangement shown, the groove 500 may be formed of a dense material, such as metals, composites, etc. as described above. The insert 502 may be formed of a softer metal, polymer, thermal plastic, and the like, as described above. In some arrangements, the insert 502 may be formed of the same material as the groove 500. That is, both the insert 502 and groove 500 may be formed of a dense metal. The compressible support 520 may, in some arrangements, be formed of a polymer, thermal plastic, or other similar material that is configured to compress when the club face strikes the ball. For example, as the club head strikes a golf ball, the v-shaped insert 502 will contact the ball and the compressible support 520 will compress to permit additional contact between the groove 500 and the ball.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club, comprising:

a club shaft;

an iron-type golf club head configured at one end of the club shaft and having a club face constructed from a first material;

a plurality of grooves formed in the club face including a first groove and a second groove separate from the first groove, each of the first and second grooves being defined in the first material and including an open front end, a top surface, a bottom surface opposite the top surface, and a closed end surface connecting the top surface and the bottom surface and located opposite the open front end;

a first insert arranged within the first groove, the first insert being formed of a second material, softer than the first material and the first insert having a shape corresponding to the shape of the first groove and a v-shaped end exposed at the open front end of the first groove; and a second insert arranged within the second groove, the second insert being formed of the second material, the second insert having a shape corresponding to the shape of the second groove and a v-shaped end exposed at the open front end of the second groove, and wherein the second insert is a separate and independent part from the first insert, wherein the first and second inserts are compressible with respect to the first and second grooves, respectively, in which they are mounted such that the open ends of the first and second grooves provide a v-shaped cross section when the first and second inserts are in an uncompressed state and such that the open ends of the first and second grooves provide a u-shaped cross section when a golf ball is struck at the first and second grooves to thereby compress the first and second inserts.

2. The iron-type golf club of claim 1, wherein the first material is at least one of carbon steel, stainless steel and titanium.

3. The iron-type golf club of claim 1, wherein the second material is at least one of a polymer, and a soft metal.

4. An iron-type golf club, comprising:

a club shaft;

an iron-type golf club head configured at one end of the club shaft and having a club face constructed from a first material;

a plurality of grooves formed in the club face including a first groove and a second groove separate from the first groove, each of the first and second grooves being defined in the first material and including an open front end, a top surface, a bottom surface opposite the top surface, and a closed end surface connecting the top surface and the bottom surface and located opposite the open front end;

a first insert arranged within the first groove, the first insert being formed of a material having a softer durometer than a durometer of the first material, the first insert having a v-shaped end exposed at the open front end of the first groove and configured to be compressed when the club face strikes a golf ball, wherein portions of the first groove adjoining the first insert are configured to impart spin on the golf ball when the club face strikes the golf ball; and a second insert arranged within the second groove, the second insert being formed of a material having a softer durometer than the durometer of the first material, the second insert having a v-shaped end exposed at the open front end of the second groove and configured to be compressed when the club face strikes a golf ball, wherein the second insert is a separate and independent part from the first insert, and wherein portions of the second groove adjoining the second insert are configured to impart spin on the golf ball when the club face strikes the golf ball, and wherein the first and second inserts are compressible with respect to the first and second grooves, respectively, in which they are mounted such that the open ends of the first and second grooves provide a v-shaped cross section when the first and second inserts are in an uncompressed state and such that the open ends of the first and second grooves provide a u-shaped cross section when a golf ball is struck at the first and second grooves to thereby compress the first and second inserts.

5. The iron-type golf club of claim 4, wherein the first insert is in contact with the top surface, the bottom surface, and the closed end surface of the first groove and wherein the second insert is in contact with the top surface, the bottom surface, and the closed end surface of the second groove.

6. The iron-type golf club of claim 4, wherein the first material is at least one of carbon steel, stainless steel and titanium.

7. The iron-type golf club of claim 4, wherein the material of the first and second inserts is at least one of a polymer and a soft metal.

8. An iron-type golf club, comprising:

a club shaft;

an iron-type golf club head arranged at one end of the club shaft and having a club face formed of a first material;

a plurality of grooves formed in the club face including a first groove and a second groove separate from the first groove, each of the first and second grooves being defined in the first material and having a rectangular cross section including an open front end, a top surface, a bottom surface opposite the top surface, and a closed end surface connecting the top surface and the bottom surface and located opposite the open front end;

a first compressible support arranged within the first groove and formed of a second material, the second material being softer than the first material, the first compressible support configured to be compressed when the golf club strikes a golf ball;

a second compressible support separate and independent from the first compressible support and arranged within the second groove, the second compressible support being formed of the second material and configured to be compressed when the golf club strikes a golf ball;

a first insert arranged within the first groove, wherein the first compressible support is located between the first insert and the closed end surface of the first groove, the first insert being formed of a third material and having a v-shaped end exposed at the open front end of the first groove; and a second insert arranged within the second groove, wherein the second compressible support is located between the second insert and the closed end surface of the second groove, the second insert being formed of the third material and having a v-shaped end exposed at the open front end of the second groove, wherein the second insert is a separate and independent part from the first insert, and wherein the first and second compressible supports are compressible with respect to the first and second grooves, respectively, in which they are mounted such that the open ends of the first and second grooves provide a v-shaped cross section when the first and second compressible supports are in an uncompressed state and such that the open ends of the first and second grooves provide a u-shaped cross section when a golf ball is struck at the first and second grooves to thereby compress the first and second compressible supports.

9. The iron-type golf club of claim 8, wherein the first groove surrounds the first compressible supports on three sides and is in contact with the first compressible support on three sides, and wherein the second groove surrounds the second compressible support on three sides and is in contact with the second compressible support on three sides.

10. The iron-type golf club of claim 8, wherein the first groove is in contact with two opposite sides of the first insert, and wherein the second groove is in contact with two opposite sides of the second insert.

11. The iron-type golf club of claim 8, wherein the second material is configured to be compressed to a greater degree than the first material and the third material when the golf club strikes the golf ball.

12. The iron-type golf club of claim 8, wherein the first and third materials are the same material.

13. The iron-type golf club of claim 8, wherein the first, second and third materials are all different materials.

14. The iron-type golf club of claim 8, wherein the second material is a polymer.

15. An iron-type golf club head, comprising:

a striking face constructed from a first material;

a plurality of grooves including a first groove and a second groove separate from the first groove formed in the striking face, each of the first and second grooves having a rectangular cross section and being defined in the first material, and each of the first and second grooves including an open front end, a top surface, a bottom surface opposite the top surface, and a closed end surface connecting the top surface and the bottom surface and located opposite the open front end;

a first insert arranged within the first groove, the first insert having a v-shaped end exposed at the open front end of the first groove, and the first insert being made from a material having a compressibility greater than a compressibility of the first material; and a second insert arranged within the second groove, the second insert having a v-shaped end exposed at the open front end of the second groove, and the second insert being made from a material having a compressibility greater than a compressibility of the first material, and wherein the first and second inserts are compressible with respect to the first and second grooves, respectively, in which they are mounted such that the open ends of the first and second grooves provide a v-shaped cross section when the first and second inserts are in an uncompressed state and such that the open ends of the first and second grooves provide a u-shaped cross section when a golf ball is struck at the first and second grooves to thereby compress the first and second inserts.

16. The iron-type golf club head of claim 15, wherein the first insert is in contact with the first groove on three sides, and wherein the second insert is in contact with the second groove on three sides.

* * * * *